US008221586B2

(12) United States Patent
Haslop

(10) Patent No.: US 8,221,586 B2
(45) Date of Patent: Jul. 17, 2012

(54) SECURITY SUBSTRATE COMPRISING WATERMARK

(75) Inventor: John Martin Haslop, Berkshire (GB)

(73) Assignee: De La Rue International Limited, Basingstoke, Hampshire (GB)

( * ) Notice: Subject to any disclaimer, the term of this patent is extended or adjusted under 35 U.S.C. 154(b) by 471 days.

(21) Appl. No.: 12/299,580

(22) PCT Filed: May 3, 2007

(86) PCT No.: PCT/GB2007/001618

§ 371 (c)(1),
(2), (4) Date: Dec. 4, 2008

(87) PCT Pub. No.: WO2007/129051

PCT Pub. Date: Nov. 15, 2007

(65) Prior Publication Data

US 2010/0006248 A1 Jan. 14, 2010

(30) Foreign Application Priority Data

May 8, 2006 (GB) ..... 0609053.4

(51) Int. Cl.

| | |
|---|---|
| ***B42D 15/00*** | (2006.01) |
| ***D21F 1/44*** | (2006.01) |
| ***D21H 27/02*** | (2006.01) |
| ***D21H 21/28*** | (2006.01) |

(52) U.S. Cl. ..... 162/140; 162/109; 162/134; 162/117; 162/162; 283/72; 428/156; 428/195.1

(58) Field of Classification Search ..... 162/109–110, 162/117, 134–137, 140, 158, 162, 204; 283/72, 283/95; 428/156, 172, 195.1, 292.1
See application file for complete search history.

(56) References Cited

U.S. PATENT DOCUMENTS

| | | | | |
|---|---|---|---|---|
| 7,959 A | | 3/1851 | Brewer et al. | |
| 2,711,120 A | * | 6/1955 | MacLaurin | 162/110 |
| 3,366,531 A | * | 1/1968 | Long | 428/156 |
| 4,534,398 A | * | 8/1985 | Crane | 162/103 |
| 5,447,335 A | * | 9/1995 | Haslop | 283/91 |

(Continued)

FOREIGN PATENT DOCUMENTS

DE 10064006 A1 7/2002

(Continued)

OTHER PUBLICATIONS

Case Paper, Paper Thickness Chart, Date unknown, pp. 1-2.*

(Continued)

*Primary Examiner* — Jose A Fortuna
(74) *Attorney, Agent, or Firm* — GableGotwals

(57) ABSTRACT

The invention relates to improvements in security substrates and in particular to fibrous security substrates, such as paper, incorporating a watermark. The security substrate comprises a fibrous base layer, having a normal base fiber density, said base layer incorporating a watermark consisting of a plurality of alphanumeric characters. Each character comprises dark and/or light regions, the dark regions being formed by more densely deposited fibers than the normal base fiber density and the light regions being formed by less densely deposited fibers than the normal base fiber density. The density of the fibers in any region is substantially uniform such that there is no gradual change of tone between the light and dark regions. Each dark and light region adjoins at least one light and dark region respectively and an area of normal fiber density.

17 Claims, 1 Drawing Sheet

U.S. PATENT DOCUMENTS

| | | | | |
|---|---|---|---|---|
| 5,449,200 | A * | 9/1995 | Andric et al. | 283/67 |
| 5,678,863 | A * | 10/1997 | Knight et al. | 283/113 |
| 5,961,432 | A | 10/1999 | Murakami et al. | |
| 6,402,888 | B1 * | 6/2002 | Doublet et al. | 162/140 |
| 6,409,592 | B1 | 6/2002 | McCoy et al. | |
| 6,991,846 | B2 * | 1/2006 | Mallol et al. | 428/292.1 |
| 7,399,513 | B2 * | 7/2008 | Pearson et al. | 428/84 |
| 7,632,380 | B2 * | 12/2009 | Doublet | 162/140 |
| 7,704,585 | B2 * | 4/2010 | Pearson et al. | 428/84 |
| 7,738,173 | B2 * | 6/2010 | Schilling et al. | 359/573 |
| 7,883,762 | B2 * | 2/2011 | Doublet | 428/195.1 |
| 2001/0018113 | A1 * | 8/2001 | Mallol et al. | 428/195 |
| 2005/0237576 | A1 | 10/2005 | Schneider | |
| 2007/0076279 | A1 * | 4/2007 | Holmes et al. | 359/2 |
| 2010/0001508 | A1 * | 1/2010 | Tompkin et al. | 283/85 |
| 2010/0006248 | A1 * | 1/2010 | Haslop | 162/110 |
| 2010/0196587 | A1 * | 8/2010 | Keller | 427/7 |

FOREIGN PATENT DOCUMENTS

| | | | |
|---|---|---|---|
| EP | 0367520 | A2 | 5/1990 |
| EP | 0388090 | A1 | 9/1990 |
| EP | 549384 | A1 * | 6/1993 |
| EP | 1273461 | A2 | 1/2003 |
| EP | 1466755 | A2 | 10/2004 |
| GB | 2437939 | A * | 11/2007 |
| WO | WO 9209444 | A1 * | 6/1992 |
| WO | WO 2007129051 | A1 * | 11/2007 |

OTHER PUBLICATIONS

European Patent Office, "Notification of Transmittal of International Search Report and The Written Opinion of the International Searching Authority," European Patent Office, (Oct. 5, 2007).

PCT Patent Office, "Notification Concerning Transmittal of International Preliminary Report on Patentability," PCT Patent Office, (Nov. 11, 2008).

UK Patent Office, "Search Report Under Section 17," UK Patent Office, (Aug. 10, 2006).

* cited by examiner

SECURITY SUBSTRATE COMPRISING WATERMARK

CROSS-REFERENCE TO PENDING APPLICATIONS

This application is based on PCT Patent Application No. GB2007/001618, filed on May 3, 2007, which was based on United Kingdom Patent Application No. 0609053.4, filed May 8, 2006.

The invention relates to improvements in security substrates and in particular to fibrous security substrates, such as paper, incorporating a watermark.

Documents of value and means of identification, such as banknotes, passports, identification cards, certificates and the like, are vulnerable to copying or counterfeiting. The increasing availability of colour photocopiers, electronic scanning and other imaging systems, and the improving technical quality of colour photocopiers, has led to an increase in the counterfeiting of such documentation. There is, therefore, a need to continually improve the security features of such documentation, or paper, to add additional security features or to enhance the perceptions and resistance of simulation to existing features.

Steps have already been taken to introduce optically variable features into such documentation which cannot be reproduced by a photocopier or an electronic scanner. There is still, however, a demand to introduce features which are discernible by the naked eye but are "invisible" to, or are viewed differently by, a photocopier or scanner. Since the photocopying process typically involves reflecting high energy light onto an original document containing the image to be copied, one solution is to incorporate one or more features into the document which have a different perception in reflected and transmitted light. Examples of such security features include watermarks, embedded security threads, fluorescent pigments and the like.

The use of watermarks is fairly common in many security documents. High security multi-tonal watermarks are typically created using a cylinder mould process and are formed by varying the density of paper fibres so that in some regions the fibres are denser, and in others less dense, than that of the base paper layer which surrounds and separates the denser and less dense regions. When viewed in transmitted light the less dense regions are lighter and the denser regions darker than the base paper, and the contrasts can be seen very clearly. Different types of watermarks have different advantages. A multi-tonal watermark is often a pictorial image, such as a portrait, and can be very detailed and complex which significantly reduces the risk of counterfeiting.

In cylinder-mould papermaking, paper is formed on a partially submerged wire-cloth covered mould cylinder, which rotates in a vat containing a dilute suspension of paper fibres. As the mould cylinder rotates, water is drawn through the wire cloth depositing fibres onto the cylinder surface. When the wire cloth is embossed with a detailed image, the fibres deposit with a lesser or greater thickness on the raised and sunken elements of the embossing to form a fully three-dimensional watermark in the finished paper.

The variation in paper thickness in the final watermark is a result of fibre movement from the raised regions of the embossed mesh to the sunken regions of the embossed mesh as the water is drawn through the wire cloth. The fibre movement, and therefore the tonal variation in the watermark, is governed by the drainage rate and that is dependent on the profile of the embossing. This enables excellent control in the gradation of the watermark pattern, producing a subtle tonal range that is unique to the cylinder mould-made watermark process.

Embossing the wire cloth of the cylinder mould cover reduces its strength and increases the risk of damage to the paper during the papermaking process. This is particularly the case if there is a sharp transition from a deep embossing to a significantly raised area. Furthermore, within a complex pictorial watermark it is difficult to juxtapose a very light tone next to a very dark tone due to the stresses that this would place on the mould cover itself during embossing. It is thought that these are the main reasons why watermarks exhibiting adjacent strongly contrasting dark and light components have not been observed in cylinder moulds watermarks.

It is also very difficult to produce light watermark regions exhibiting a significant surface area using the cylinder mould technique. This problem is recognised in U.S. Pat. No. 6,402,888 which explains that uniform light regions cannot be produced for regions whose surface area is greater than 0.4 $cm^2$. This prior art describes the use of a watermark to produce a large thinner area of paper to create a window or more transparent area. Such an effect can be easily mimicked by the counterfeiter by using transparentising resins, UV lacquers applied locally or even cooking oil. However, there is a significant problem arising from the use of large thinner areas both in respect of weakening the paper and its poor security.

An alternative process for generating uniform light tonal regions (and providing enhanced watermark security) is the electrotype process. In the electrotype process a thin piece of metal, generally in the form of an image or letter, is applied to the wire cloth of the cylinder mould cover, by sewing or welding, creating a significant decrease in drainage and fibre deposition and thereby forming a light watermark in the paper. An electrotype watermark may be lighter than a watermark generated, and produced, by conventional embossing. This electrotyping process is well known in papermaking and has been described in U.S. Pat. No. 1,901,049 and U.S. Pat. No. 2,009,185.

An electrotype watermark is therefore an area of paper having just a uniform decrease in paper thickness. The area is typically quite small and the change in paper thickness quite distinct so as to create a very light, usually lighter than areas within a pictorial watermark.

Both the aforementioned types of watermark have their security benefits and have provided the backbone of paper security for hundreds of years. However, both can be compromised and, as with all security devices, there is a need to improve them. One approach is to provide ever more complex and technically demanding designs. The complexity of such designs enables a counterfeit to be spotted more easily by the expert. However it should be recognised that the majority of individuals handling security documents are not experts in watermarks. Thus a complex technically demanding watermark need only be copied sufficiently well to convince the ordinary man in the street. Thus there is a need to produce a watermark that is easily recognisable, and hard to counterfeit.

In order to achieve this, it is important to understand how a watermark functions and also how a counterfeiter goes about simulating a watermark. A watermark functions by making use of absolute changes in tonality (changes in the thickness of paper resulting from variations in fibre density) and apparent changes in tonality (perception of tonal changes). Regarding the latter, to the human eye an effect of a light and dark tone can be created by simply using darker tones. Likewise a tonal effect can also be achieved by simply using lighter tones.

The designer of a watermark makes use of this effect to create designs by juxtaposition tones to create an effect of greater tonal variation than is actually present. This requires great skill and judgement. However the counterfeit is also able to make use of human perception to create an imitation. The counterfeiter need only create an overall impression of changing tonality and, without a genuine watermark to compare against, the ordinary man in the street is not likely to pick up on the fact that a dark tone and a light tone do not have the correct contrast. All they will see is a dark and light tone, i.e. he will recognise that they are different, but would not recognise by how much they are different.

It is an object of the present invention to provide an improved watermarked security substrate which is both easily recognisable and hard to counterfeit.

According to the invention there is provided a security substrate comprising a fibrous base layer, having a normal base fibre density, said base layer incorporating a watermark consisting of a plurality of alphanumeric characters, each character comprising dark and/or light regions, the dark regions being formed by more densely deposited fibres than the normal base fibre density and the light regions being formed by less densely deposited fibres than the normal base fibre density, the density of fibres in any region being substantially uniform such that there is no gradual change of tone between the light and dark regions, wherein each dark and light region adjoins at least one light and dark region respectively and an area of normal fibre density.

It has surprisingly been found that the production of a substrate with watermarks according to the present invention does not lead to the detrimental effects described above. The selection of alphanumeric designs helps to reduce any risk of damage to the mould cover weakening of the paper. Pictorial images, on the other hand, are inherently complex and typically have numerous changes in tonality which would increase the detrimental effects.

The viewer is thus able to see both extreme dark and light tones directly juxtaposed and referenced against the tone of the base substrate. These three tones in combination enhance the security of the substrate over substrates with existing tonal and electrotype watermarks.

Such a device also makes it far harder for the counterfeiter to produce a watermark that simulates the tonal effect as they also have to provide a device having a distinct and definite contrast of tone.

The use of an electrotype, in combination with an embossing, in accordance with a preferred embodiment of the invention, further limits any detrimental effects to the embossing wire in the paper making process.

A preferred embodiment of the present invention will now be described in detail, by way of example only, with reference to the accompanying drawings in which:—

Figure 1:
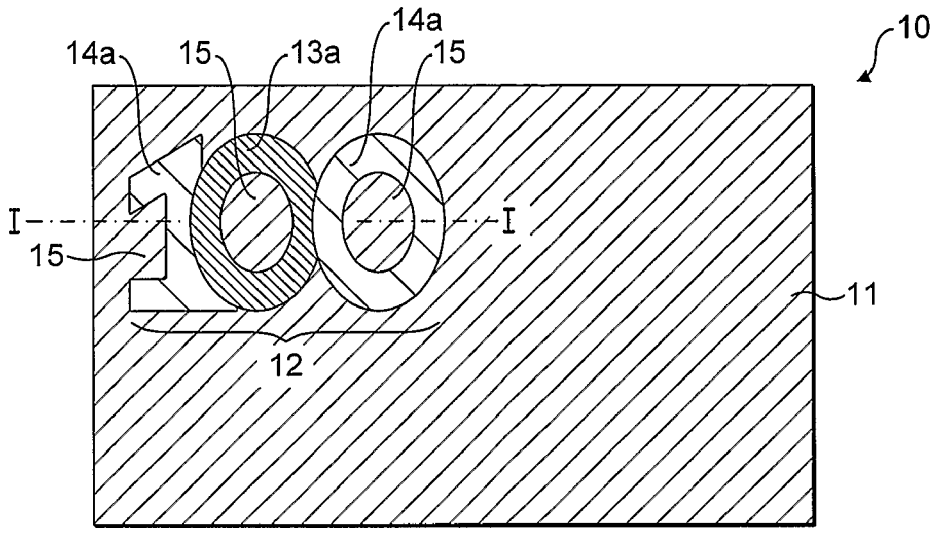
FIG. 1 is a plan view of a security substrate according to the present invention.
Figure 2:
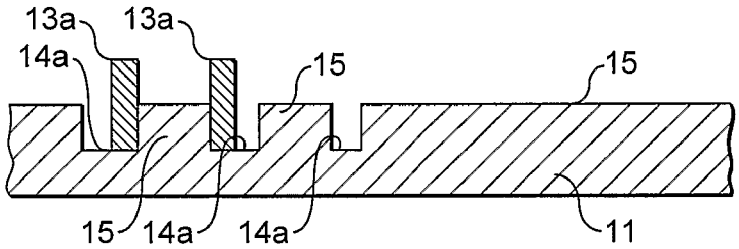
FIG. 2 is a cross-sectional elevation of a portion of the substrate of FIG. 1 on the line I-I.

Referring to FIGS. 1 and 2, a security substrate 10 is formed from a fibrous base layer 11, such as paper, and comprises a watermark 12. In this example the watermark 12 is in the form of the numeral 100.

The base layer 11 may be made using known papermaking techniques on papermaking machines, such as a cylinder mould or Fourdrinier machine, or it may even be hand-made. A range of fibre types can be used in the making of such paper, including synthetic or natural fibres or a mixture of both.

The watermark 12 of the present invention comprises a plurality of dark regions comprising an area of thicker paper 13*a* formed by more densely deposited fibres and light regions, comprising an area of thinner paper 14*a* formed by less densely deposited fibres as compared to the normal fibre density or thickness 15 of the rest of the substrate 10. Each dark or light region 13*a*, 14*a* abuts a light or dark region 14*a*, 13*a* and an area of normal paper thickness 15. The density of fibres in each of the regions is substantially uniform across that region. Thus, unlike in a pictorial watermark, in the present invention there is no gradual change in tone between the light and dark regions; instead there is an abrupt change which is clearly noticeable when viewed with a naked eye.

The watermark 12 is selected so as to define simple alphanumeric information which can be immediately determined by the viewer. The alphanumeric information may comprise western or non-western scripts. In FIG. 1 the numerical characters 100 are defined as a stylised device where each character appears to overlap, link with or be overlapped by an adjacent character. The region of each character which abuts an adjacent character has a contrasting dark or light tone compared to the adjacent character(s) and each light/dark region lies adjacent an area of normal paper thickness 15.

Figure 3:
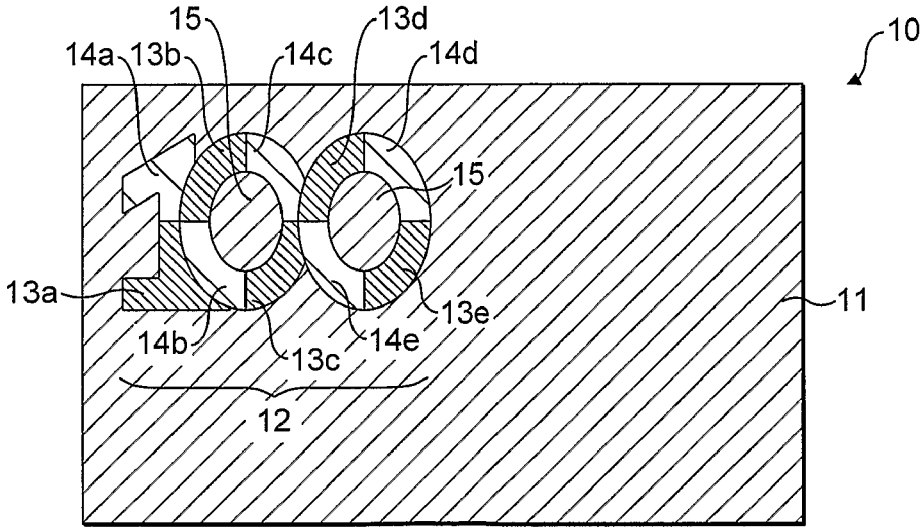
FIG. 3 is a plan view of an alternative security substrate to FIG. 1.

In an alternative example shown in FIG. 3, each character of the alphanumeric information also incorporates both dark and light regions juxtaposed. Thus the numeral "1" has a dark region 13*a* and a light region 14*a*; the adjacent numeral "O" has dark regions 13*b* and 13*c* and light regions 14*b* and 14*c*; the second numeral "0" has dark regions 13*d* and 13*c* and light regions 14*d* and 14*e*.

It is envisaged that the normal thickness of the base layer 11 for making the substrate 10 according to the present invention will be in the range of 50-150 microns and more preferably in the range of 90-130 microns. The thickness of the substrate within the watermark is reduced by at least 20% within the lighter areas, and more preferably by at least 25%. In the darker regions, the thickness of the substrate is increased by at least 10%, and more preferably by at least 15%.

In a preferred embodiment of the invention the thickness of the dark regions lies in the range of 55 to 165 microns, more preferably in the range of 100 to 140 microns and more preferably still in the range of 40 to 120 microns. The thickness of the light regions preferably lies in the range of 35 to 110 microns.

From an anti-counterfeiting viewpoint, it is recognised that the actual grammage of the paper within the watermark has a significant effect on the clarity of the watermark. Furthermore, whilst the varying density of the paper fibres affects the visibility of the watermark in both reflected and transmitted light, the varying thickness of the paper has an effect on the tactility of the watermark whereby raised or thicker regions can be felt where the fibres are denser. The density of fibres can be varied by varying the relative depth in the watermarking dies so that the relative quantity of fibres deposited in different regions of the watermark differ dramatically enough to be distinguished by touch.

Although the size of the watermark 12 is dependent upon the size of the document made from the security substrate 10, for a typical banknote it is preferred that the watermark 12 has a surface area in the range 20 $mm^2$ to 250 $mm^2$.

Within the watermark 12, the dark and light regions 13*a*, 13*b*, 14*a*, 14*b*, 14*c* preferably each form 50% of the surface area of the watermark 12. However, the preferred minimum surface area for either the dark regions 13*a*, 13*b* or light regions 14*a*, 14*b*, 14*c* is 25%.

The density of the paper can also be affected by adding other components to the papermaking furnish, such as fillers which change the opacity of the paper. Thus regions with more fibres made from a furnish including fillers will appear much more opaque than those regions with fewer fillers or indeed paper without such fillers. Colouring the base layer 11 also affects the visibility of the watermark and the depth of clarity between the light and dark regions.

When viewed in transmission, the dark regions transmit in the region of 10 to 40% less light than the surrounding base layer, and more preferably 10 to 30% less. The light regions preferably transmit in the region of 5 to 90% more light than the surrounding base layer, and more preferably in the region of 5 to 30%.

The present invention is also highly compatible with many other security features to enhance the security of the substrate 10. For example, a wide range of different types of security thread can be used, including holographic threads, demetallised threads, demetallised holographic threads, fluorescent threads, thermochromic threads, coloured/metallised threads, machine-readable threads, optically variable threads and microprinted threads. Other surface features may also be included such as planchette bands, fibre bands, iridescent coatings and transparentising coatings and print.

The security substrate 10 according to the present invention is also compatible within any known forms of printing such as intaglio, flexo-gravure, ink jet, hot foil stamping and so on. Documents made from labels 10 may also be provided with a glossy or other finish which is clear or translucent.

Such security substrates 10 may have a wide range of uses common examples of documents made from such substrates include banknotes, certificates of value, share certificates, passports and the like.

In one preferred embodiment the security substrate of the current invention is produced on a cylinder mould papermachine. The wire cloth of the cylinder mould cover is embossed to create adjacent raised and sunken regions. During papermaking the raised and sunken regions form the subsequent light and dark regions respectively in the watermark of the current invention.

In a second preferred embodiment, the security substrate is again produced on a cylinder mould papermachine. The wire cloth of the cylinder mould is embossed to create the dark regions of the watermark but in this embodiment the light regions are created using an electrotype. This is created by attaching a metallic electrotype element or a polymeric sealing compound to the cylinder mould cover, resulting in a significant decrease in drainage through the cover and reduced fibre deposition, forming a light region in the paper.

The invention claimed is:

1. A security substrate comprising a fibrous base layer having a base fibre density, said base layer incorporating a watermark consisting of a plurality of alphanumeric characters, each character comprising at least one of a dark region and at least one of a light region, the dark region being formed by more densely deposited fibres than the base fibre density and the light region being formed by less densely deposited fibres than the base fibre density, the density of fibres in any region being substantially uniform such that there is no gradual change of tone between the light and dark region, wherein each dark and light region adjoins at least one light and dark region respectively and an area of base fibre density.

2. A security substrate as claimed in claim 1 in which the at least one dark light region having an increased thickness of at least 10% of the thickness of the base layer surrounding the watermark, and the at least one light region having a reduced thickness of at least 20% of the thickness of the base layer surrounding the watermark.

3. A security substrate as claimed in claim 2 in which the at least one dark region having an increased thickness of at least 15% of the thickness of the base layer surrounding the watermark, and the at least one light region having a reduced thickness of at least 25% of the thickness of the base layer surrounding the watermark.

4. A security substrate as claimed in claim 1 in which the at least one dark region of the watermark is produced by an embossing on a support surface on which the substrate is made and the at least one light region is produced by an electrotype attached to the support surface.

5. A security substrate as claimed in claim 1 in which abutting regions of adjacent characters of the watermark are formed from contrasting dark and light regions respectively.

6. A security substrate as claimed in claim 1 in which the thickness of the at least one dark region lies in the range of 55 to 165 microns.

7. A security substrate as claimed in claim 6 in which the thickness of the at least one dark region lies in the range of 100 to 140 microns.

8. A security substrate as claimed in claim 1 in which the thickness of the at least one light region lies in the range 40 to 120 microns.

9. A security substrate as claimed in claim 8 in which the thickness of the at least one light region lies in the range of 35 to 110 microns.

10. A security substrate as claimed in claim 1 in which the fibrous base layer is paper.

11. A security substrate as claimed in claim 1 in which the variations in thickness are effected by changes in the density of fibres of the base layer.

12. A security substrate as claimed in claim 1 in which an opacity altering component is used to increase the contrast in opacity of the dark and light regions.

13. A security substrate as claimed in claim 1 in which a colouring component is used to modify the contrast between dark and light regions.

14. A security substrate as claimed in claim 1 in which at least one of the dark region and at least one of the light region forms at least 25% of the area of the watermark.

15. A security substrate as claimed in claim 14 in which the at least one dark region and the at least one light region each form 50% of the area of the watermark.

16. A security document formed from a security substrate, the security substrate comprising a fibrous base layer having a base fibre density, said base layer incorporating a watermark consisting of a plurality of alphanumeric characters, each character comprising at least one of a dark region and at least one of a light region, the dark region being formed by more densely deposited fibres than the base fibre density and the light region being formed by less densely deposited fibres than the base fibre density, the density of fibres in any region being substantially uniform, such that there is no gradual change of tone between the light and dark region, wherein each dark and light region adjoins at least one light and dark region respectively and an area of base fibre density.

17. A security document as claimed in claim 16 comprising one of a banknote, a certificate of value, a share certificate, and a passport.

* * * * *